US006472115B2

(12) United States Patent
Uezono et al.

(10) Patent No.: US 6,472,115 B2
(45) Date of Patent: Oct. 29, 2002

(54) IMAGE FORMING APPARATUS AND IMAGE FORMING METHOD

(75) Inventors: Tsutomu Uezono; Yasuhiro Funayama; Takeshi Hori; Tomoyuki Yoshii, all of Tokyo (JP)

(73) Assignee: NEC Corporation, Tokyo (JP)

( * ) Notice: Subject to any disclaimer, the term of this patent is extended or adjusted under 35 U.S.C. 154(b) by 27 days.

(21) Appl. No.: 09/819,651

(22) Filed: Mar. 29, 2001

(65) Prior Publication Data

US 2001/0026714 A1 Oct. 4, 2001

(30) Foreign Application Priority Data

Mar. 31, 2000 (JP) ..... 2000-099516

(51) Int. Cl.[7] ..... G03G 13/06; G03G 15/00

(52) U.S. Cl. ..... 430/102; 399/50; 399/51; 399/169; 399/264

(58) Field of Search ..... 430/102; 399/50, 399/51, 169, 264

(56) References Cited

FOREIGN PATENT DOCUMENTS

| | | |
|---|---|---|
| JP | 5-88837 | 12/1993 |
| JP | 7-253704 | 10/1995 |
| JP | 2897705 | 3/1999 |

*Primary Examiner*—Mark Chapman

(74) *Attorney, Agent, or Firm*—Whitham, Curtis & Christofferson, P.C.

(57) ABSTRACT

An image forming apparatus of the present invention includes a particle conveying body made up of a light-transmitting conductive layer, an insulative screen provided on the conductive layer and formed with a number of pores, and a screen electrode formed on the screen. Photoconductive, colored particles are charged to negative polarity and then caused to fill the pores by an electric field. When the particles in the pores are exposed via the conductive layer, electron-hole pairs are generated in the particles. An electric field of as high as $10^4$ V/cm or above is formed between the conductive layer and the screen electrode and separates the electrons and holes. The electrons leak to the conductive layer and cause the particles to be charged to positive polarity. An electric field formed between a facing electrode positioned behind a recording medium and the conductive layer causes the particles to fly toward and deposit on the medium.

57 Claims, 10 Drawing Sheets

IMAGE FORMING APPARATUS AND IMAGE FORMING METHOD

BACKGROUND OF THE INVENTION

The present invention relates to a copier, printer, facsimile apparatus or similar image forming apparatus and an image forming method and more particularly to an image forming apparatus of the type causing colored particles to fly for forming an image on a paper sheet or similar recording medium.

An electrophotographic process has been extensively applied to a copier, printer, facsimile apparatus or similar image forming apparatus. Typical of the electrophotographic process is a Carlson method (xerography). However, the problem with the Carlson method is that it needs a charging step, an exposing step, a developing step, an image transferring step, a fixing step and a cleaning step, i.e., six consecutive steps in total. Such a process is not practicable without resorting to a sophisticated, bulky construction. Japanese Patent 2,897,705 discloses a simple electrophotographic process that is a substitute for the Carlson method. The electrophotographic process taught in this document does not charge a photoconductive element and thereby reduces the number of steps (Prior Art 1 hereinafter).

Japanese Patent No. 1,876,764 teaches an electrophotographic recording method directed toward a higher toner transfer speed and the obviation of fog (Prior Art 2 hereinafter). Prior Art 2 includes a toner carrying member made up of a transparent base, a transparent electrode, and a carrier transport layer. Toner formed of a carrier generating material is charged by friction and caused to deposit on the surface of the toner carrying member. Light selectively scans the toner via the transparent base of the toner carrying member in order to invert the polarity of the toner. A transfer electrode is positioned behind a paper sheet or similar recording medium and biased to negative polarity. The transfer electrode causes the toner inverted in polarity to electrostatically move toward the paper sheet.

Further, Japanese Patent Laid-Open Publication No. 7-253704 proposes an image forming apparatus constructed to obviate defective image transfer, e.g., the adhesion of toner and fog (Prior Art 3 hereinafter). In Prior Art 3, photoconductive toner is charged to negative polarity by friction and coated on a transparent, conductive carrying member. When the toner is exposed, the resistance of the toner lowers with the result that the negative charge of the toner flows to the above carrying member. A power supply forms an electric field for image transfer between the carrying member and a facing electrode facing the carrying member via a gap. The power supply injects positive charge in the toner by contact induction charging. As a result, the toner flies toward the facing electrode via the gap and deposits on a recording medium.

Prior Art 1, however, gives rise to some problems that will be described specifically later.

As for Prior Art 2, when an organic carrier generating material is used, light causes electron-hole pairs to be generated in the material. Prior art 2, however, does not address to a problem that a high-tension electric field is essential for electrons and holes to separate from each other and migrate at a practical speed. Specifically, a practical electric field does not cause the particles to fly or needs a long period of time for the migration of charge and the flight of the particles, failing to implement a practical printing speed. More specifically, it is known that an electric field as high as $10^4$ V/cm is necessary for electrons and holes in an organic material to separate from each other or for a separated charge carrier to migrate at a sufficiently high speed. Such a value is of the order of a breakdown start electric field of air. Should the high-tension electric field be applied between transferring means and a transparent electrode included in Prior Art 2, the breakdown of air would occur. That is, Prior Art 2 cannot exceed the above value of the electric field and therefore cannot solve the above practicality problem.

Prior Art 3 teaches that when photoconductive toner is exposed under a preselected electric field for transfer, the resistance of the toner lowers with the result that charge is injected from an electrode into the toner. Generally, however, the resistance of toner and therefore an electric field that causes the toner to start flying on the basis of charge injection is irregular. Prior Art 3 relies only on an electric field for image transfer and therefore sometimes causes even the toner in unexposed portions to start flying, resulting in a fog image.

Technologies relating to the present invention are also disclosed in, e.g., Japanese Patent Publication No. 5-88837.

SUMMARY OF THE INVENTION

It is therefore an object of the present invention to provide an image forming apparatus capable of forming a high-resolution, fog-free image, using even an organic photoconductive material, and realizing a simple, highly practical process for causing toner to fly toward a recording medium.

In accordance with the present invention, an image forming apparatus for causing photoconductive, colored particles to deposit on a recording medium includes a particle conveying body made up of a light-transmitting photoconductive layer, an insulative screen provided on the conductive layer and formed with a plurality of pores to be filled with the colored particles, and an electrode layer formed on the top of the screen. A particle feeding section feeds the colored particles charged to a first polarity to the particle conveying body. A facing electrode faces the particle conveying body with the intermediary of a recording medium. An exposing member exposes the colored particles via the conductive layer in accordance with an image signal to thereby charge the particles to a second polarity. A first electric field applying device applies a first electric field, which electrically attracts the colored particles charged to the first polarity toward the conductive layer, between the conductive layer and the electrode layer. A second electric field applying device applies a second electric field, which electrically attracts the charged particles charged to the second polarity toward the facing electrode, between the facing electrode and the conductive layer. A body driving device causes the particle conveying body to move between the particle feeding section and the facing electrode in circulation. Also, in accordance with the present invention, an image forming method begins with a step of uniformly charging photoconductive, colored particles to a first polarity. The colored particles charged to the first polarity are caused to fill a plurality of pores of a particle conveying body that is made up of a conductive layer transparent for light, an insulative screen provided on the conductive layer and formed with the pores, and an electrode layer formed on the top of the screen. Light for exposure is radiated from the bottom side of the pores. A first electric field, which electrically attracts the colored particles charged to the first polarity toward the conductive layer, is formed between the electrode layer and the conductive layer. The light and first electric field are caused to charge the colored particles to a second polarity opposite to the first polarity. A second electric field is formed between a facing electrode, which faces the particle conveying body with the intermediary of a recording medium, and the conductive layer to thereby cause the colored particles to fly toward and deposit on the recording medium.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
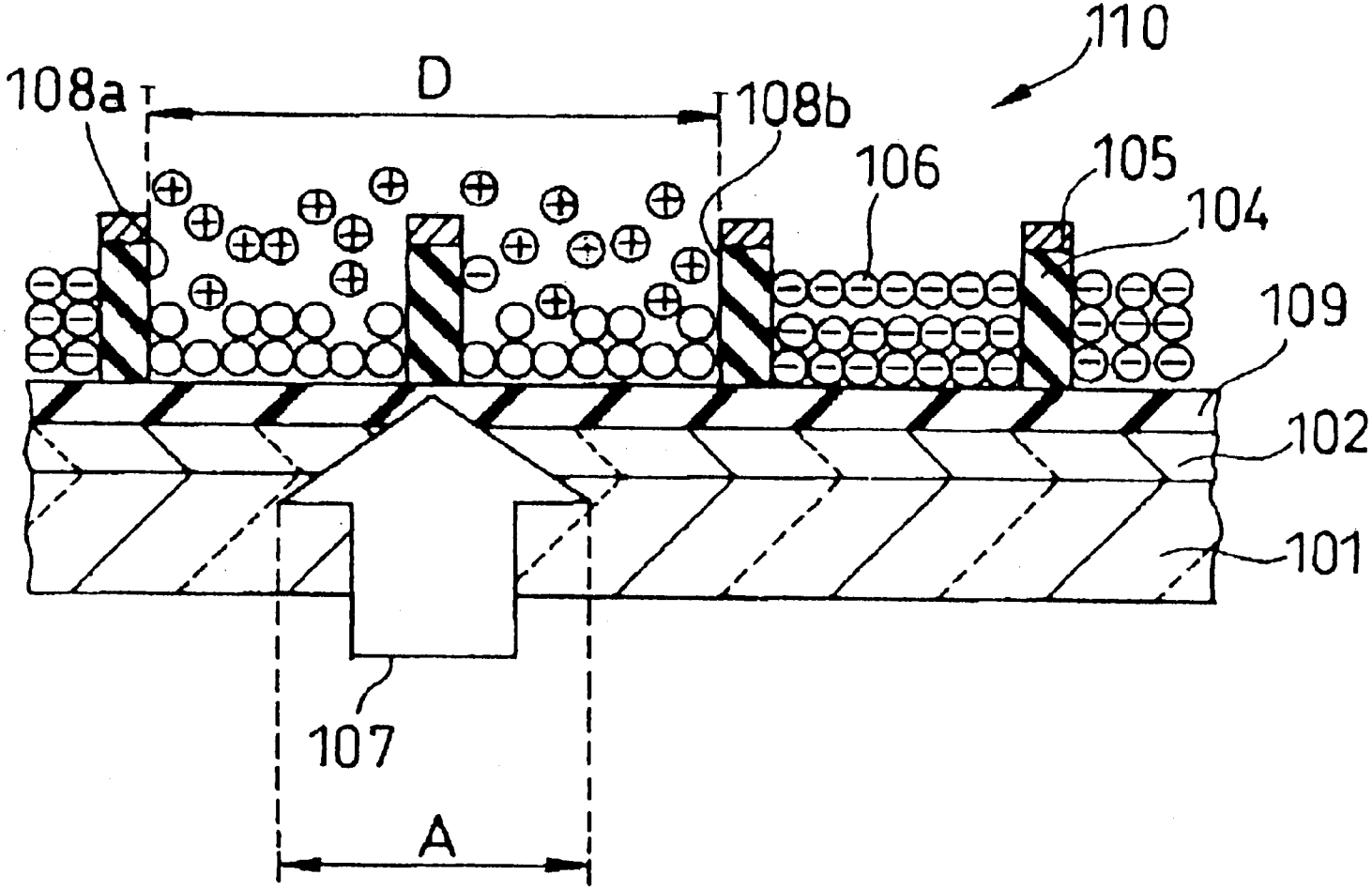
FIG. 1 PRIOR ART
FIG. 1 is a section showing a conventional image forming method.

To better understand the present invention, brief reference will be made to the image recording method taught in accordance with Prior Art 1 stated earlier, shown in FIG. 1. As shown, a photoconductor unit 110 is included in a recording section and faces a paper sheet or similar recording medium, not shown, via a preselected gap. The photoconductor unit 110 includes a base 101 made of glass or similar light-transmitting material. A conductive, light-transmitting layer 102 and a photoconductive layer 109 are sequentially formed on the base 101. A porous, insulative screen 104 is formed on the photoconductive layer 109 and has a screen electrode or electrode layer 105 formed on its top.

Before a recording medium faces the photoconductor unit 110, conductive, colored particles 106 that are charged to negative polarity by induction charging fill the pores of the insulative screen 110. A facing electrode, not shown, is positioned behind the recording medium. An electric field is formed between the facing electrode and the conductive layer 102 and causes positively charged particles to fly toward the recording medium. During recording, an LED (Light Emitting Diode) array, for example, selectively emits light 107 in accordance with an image signal. The light 107 is incident to the photoconductive layer 109 via the base 101 and conductive layer 102.

The light 107 lowers the resistance of the photoconductive layer 109. As a result, the charge of the negatively charged particles 106 flows into the photoconductive layer 109, i.e., the particles 106 looses their charge. An electric field is formed between the conductive layer 102 and the screen electrodes 105. This electric field, coupled with the electric field formed between the conductive layer 102 and the facing electrode, charges the particles 106 close to the photoconductive layer 109 to negative polarity and charges the particles 106 remote from the same to positive polarity. The particles 106 with positive charge fly toward the facing electrode due to the electric field between the conductive layer 102 and the facing electrode. The particles 106 deposited on the recording medium are fixed thereon by a fixing process.

Prior Art 1 has the following problems left unsolved. The light 107 representative of a single pixel sometimes exposes the photoconductor unit 110 over a range D including a plurality of pores 108*a* and 108*b* of the screen 104. In such a case, the conductive particles 106 migrate not only in the vertical direction, but also in the horizontal direction. Consequently, all the particles in the pores 108*a* and 108*b* are reversed in polarity even if the individual pore 108*a* or 108*b* is only partly exposed. Therefore, the particles 106 present in the range D, which is broader than the area of a single pixel, fly and deteriorate the resolution of an image.

The screen 104 is formed on the photoconductive layer 109 by use of ultraviolet-curable resin. At this instant, ultraviolet rays passed through a lattice pattern are irregularly reflected by the interface between the screen 104 and the photoconductive layer 109. The irregular reflection prevents the pores of the screen 104 from being formed with accuracy.

Figure 2:
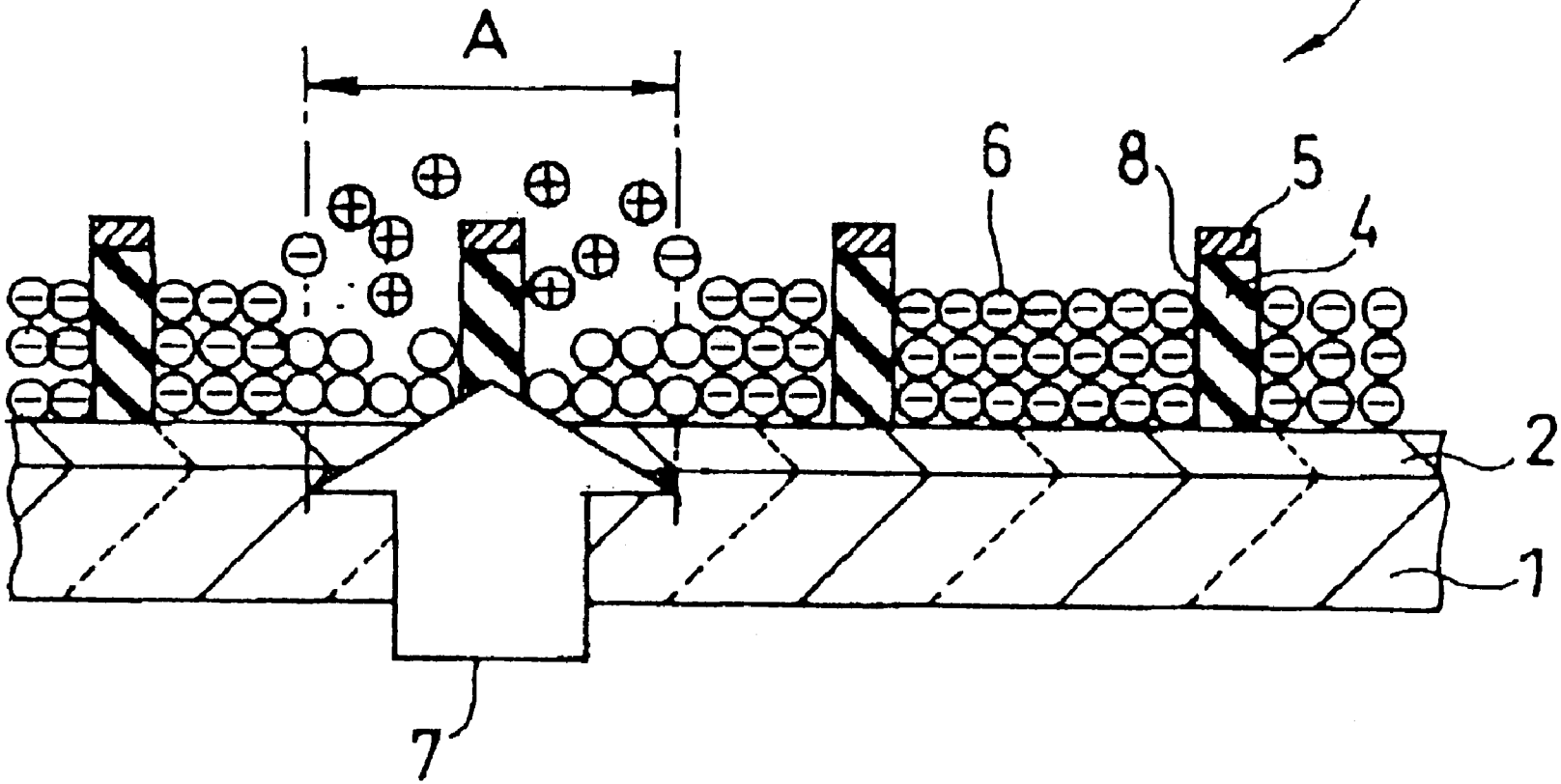
FIG. 2 is a section showing a first embodiment of the image forming apparatus in accordance with the present invention, particular a particle conveying body included therein.

Referring to FIG. 2 of the drawings, a first embodiment of the image forming apparatus in accordance with the present invention will be described. As shown, the apparatus includes a particle conveying body 10 including a light-transmitting base 1. The base 1 is implemented as a sleeve formed of, e.g., PET (polyethylene terephthalate) and having a wall thickness of, e.g., 50 $\mu$m. A light-transmitting conductive layer 2 and an insulative screen or layer 4 are sequentially formed on the base 1. The conductive layer 2 may be implemented by an ITO (Indium Tin Oxide) film. A screen electrode 5 is formed on the top of the insulative screen 4. The screen 4 and screen electrode 5 form a number of rectangular pores 8 arranged in a lattice pattern, as seen in a top view. The light-transmitting conductive layer 2 and screen electrode 5 are connected to a power supply, so that an electric field E1 that makes the electrode 5 lower in potential than the layer 2 is formed. Photoconductive particles 6 charged to negative polarity fill the pores 8.

The base 1 may be implemented as a transparent sleeve formed of glass, acrylic resin or similar transparent material or a PET or similar transparent film in the form of an endless belt or a sleeve. The light-transmitting conductive layer 2 may be formed of any desired transparent, conductive material. For example, for the light-transmitting conductive layer 2, use may be made of an ITO, ATO or similar film formed by sputtering or dip coating or a semitransparent film formed by the vapor deposition of aluminum, gold or similar metal. In the illustrative embodiment, the light-transmitting conductive layer 2 is implemented by an ITO film greater in transmission than a semitransparent film of aluminum or similar metal. It follows that the ITO film allows the quantity of light and therefore the outlet diameter of a light source to be reduced. This successfully reduces the spot diameter of a single pixel and thereby enhances resolution. The pores 8 of the screen 4 each may have a circular shape instead of a rectangular shape, if desired.

Figure 3:
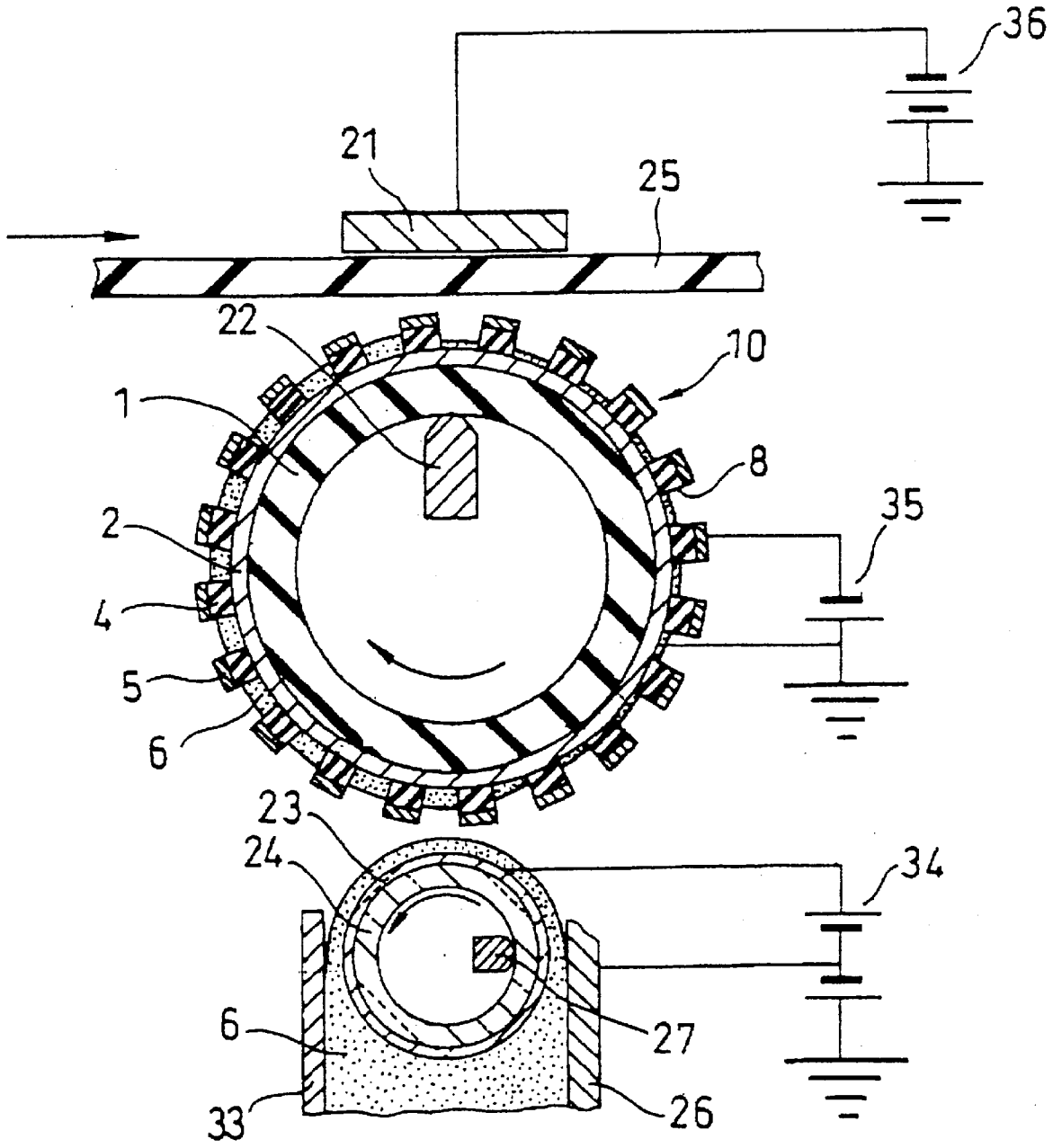
FIG. 3 is a section of the particle conveying body of FIG. 2.

As shown in FIG. 3, the particle conveying body 10 is implemented as a hollow cylinder. A hollow, cylindrical filling electrode 23 adjoins, but does not contact, the particle conveying body 10. Photoconductive, colored particles 6 expected to fill the pores 8 are deposited on the surface of the filling electrode 23 in a layer. More specifically, a reservoir or container 33 stores the photoconductive, colored particles 6. The filling electrode 23 is disposed in the reservoir 33 together with a doctor blade 26. The doctor blade 26 is spaced from the filling electrode 23 by a gap determining the thickness of the layer of the particles 6. The filling electrode 23 is formed on the surface of a hollow, cylindrical base 24 transparent for light. An LED array or similar light source 27 is accommodated in the base 24 in the vicinity of a position where the doctor blade 26 and filling electrode 23 are closest to each other. The light source 27 uniformly exposes the layer of the particles 6 existing between the doctor blade 26 and the filling electrode 23. The doctor blade 26 plays the role of a facing electrode facing the filling electrode 23 at the same time. A power supply 34 is connected to the filling electrode 23 and doctor blade 26, forming an electric field E2 between the filling electrode 23 and blade 26. Drive means, not shown, causes the filling electrode 23 to rotate.

In the arrangement shown in FIG. 3, the particles 6 are charged between the filling electrode 23 and the doctor blade 26. Light issuing from the light source 27 and electrode E2 cause the charge particles 6 to deposit on the filling electrode 23 in a layer while being regulated in thickness by the doctor blade 26. The filling electrode 23 in rotation conveys the particles 6 deposited thereon to a position where the charge electrode 23 faces the particle conveying body 10.

In the illustrative embodiment, a power supply 35 is connected to the conductive layer 2 and screen electrode 5, forming the previously mentioned electric field E1 between the layer 2 and the electrode 5. A voltage applied to the light-transmitting conductive layer 2 is selected to be higher than a voltage applied to the filling electrode 23. Consequently, the negatively charged particles 6 fly from the filling electrode 23 to the particle conveying body 10 at the position where the filling electrode 23 and body 10 face each other. Such particles 6 fill the pores 8 of the screen 4.

A facing electrode 21 faces the particle conveying body 10 via a gap at the side opposite to the side where the filling electrode 23 faces the body 10. A paper sheet or similar recording medium 25 is conveyed via the gap between the facing electrode 21 and the particle transfer body 10. The facing electrode 21 is connected to a power supply 36, so that an electric field E3 is formed between the electrode 21 and the conductive layer 2. The electric field E3 causes part of the particles 6, which fill the pores 8, charged to polarity opposite to the original polarity of the particles 6 to move toward the facing electrode 21. A light source 22 is disposed in the bore of the particle conveying body 10 for forming an image on the paper sheet 25. Drive means, not shown, causes the particle conveying body 10 to rotate.

While the facing electrode 21 is shown as being flat in FIG. 3, it may be implemented as a roller having a circular cross-section or a toothed plate, as desired.

Figure 4:
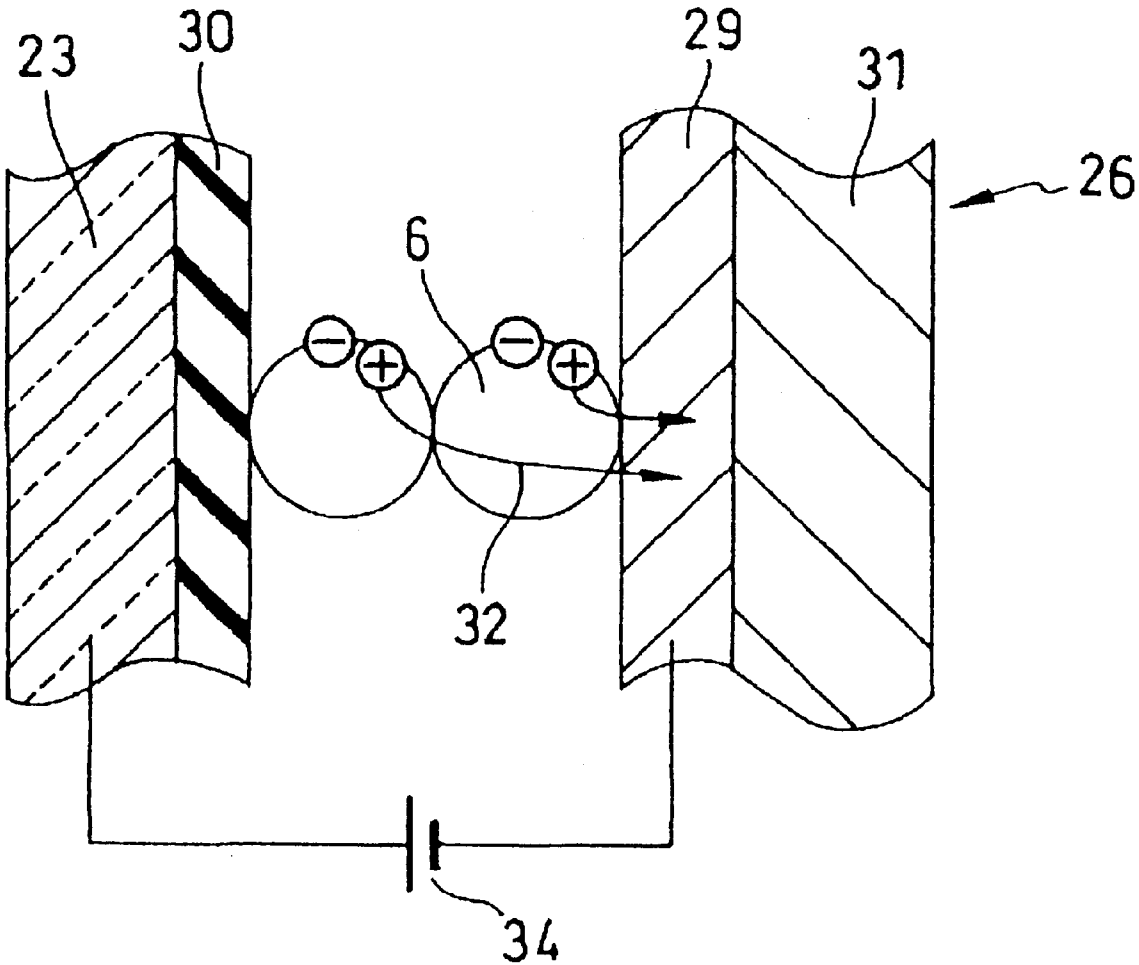
FIG. 4 is an enlarged view of a doctor bladed included in the first embodiment.

FIG. 4 shows the doctor blade 26 specifically. As shown, the doctor blade 26 is made up of a base 31 and a conductive layer 29, which plays the role of a facing electrode facing the filling electrode 23. The conductive layer 29 is formed on the surface of the base 31 that contacts the particles 6. An insulation layer 30 is formed on the surface of the filling electrode 23 that faces the doctor blade 26. The charge electrode 23 and conductive layer 29 are connected to the power supply 34, so that the previously mentioned electric field E2 is formed. The electric field E2 deposits higher potential on the filling electrode 23 than on the doctor blade 26. The insulation layer 30 is thinner than the layer of the particles 6 deposited thereon, e.g., 30 $\mu$m. With such a thickness, the insulation layer 30 allows the electric field E2 to effectively act on the layer of the particles 6 and obviates charge migration. More specifically, the insulation layer 30 obviates the injection of holes from the filling electrode 23 and the migration of electrons from the particles 6 to the filling electrode 23.

The filling electrode 23 and insulation layer 30. each are formed of a material transparent for light. To promote the migration of holes, a hole transport layer, not shown, may be formed on the surface of the conductive layer 29. A specific method of forming a hole transport layer is as follows. Polycarbonate resin Z200 available from MITSUBISHI GAS CHEMICAL CO., INC and bis(triphenylamine) styryl derivative are dissolved in a tetrahydrofuran in a mass ratio of 1:0.8, preparing a coating liquid. The coating liquid is applied to the conductive layer 29 and then dried to form an about 10 $\mu$m thick layer.

How the illustrative embodiment forms an image will be described hereinafter. First, as shown in FIG. 4, potentials of, e.g., −260 V and −200 V are respectively deposited on the conductive layer 29 of the doctor blade 26 and the filling electrode 23. The particles 6 between the doctor blade 26 and the filling electrode 23 form an about 30 $\mu$m thick layer. An electric field of $10^4$ V/cm or above is formed between the filling electrode 23 and the conductive layer 29 of the doctor blade 26. In the illustrative embodiment, the above electric field is selected to be $2\times10^4$ V/cm.

When the light source 27, FIG. 3, emits light within the hollow cylindrical electrode 23, the light uniformly charges only the particle layer existing between the doctor blade 26 and the filling electrode 23. As a result, electron-hole pairs are formed in the charge generating material that covers the particles 6. The electric field E2 formed between the filling electrode 23 and the conductive layer 29 cause holes to leak toward the doctor blade 26 with the result that the particles 6 are charged to negative polarity. The negatively charged particles 6 deposit on the filling electrode 23 in a layer whose thickness is regulated by the doctor blade 26.

Subsequently, as shown in FIG. 3, the drive means causes the filling electrode 23 carrying the negatively charged particles 6 thereon to rotate. When the particles 6 being conveyed by the filling electrode 23 face the particle conveying body 10, the electric field formed between the filling electrode 23 and the body 10 causes the particles 6 to fly toward the body 10. Such particles 6 fill the pores 8 of the screen 4.

Potential of −200 V and potential of −150 V may be deposited on the filling electrode 23 and screen electrode 5, respectively, while ground potential may be deposited on the conductive layer 2. The distance between the filling electrode 23 and screen electrode 5 may be 100 $\mu$m. The pores 8 each may be 60 $\mu$m high as measured from the conductive layer 2 to the top of the screen electrode 5. An electric field of, e.g., 2.5×10 V/cm is formed between the screen electrode 5 and the light-transmitting conductive layer 2 such that the layer 2 is higher in potential than the electrode 5. In this manner, because the screen electrode 5 is formed on the screen 4, the electric field of $10^4$ V/cm or above can be formed between the electrode 5 and the light-transmitting conductive layer 2.

While the particle conveying body 10 and filling electrode 23 are rotated by the respective drive means in opposite directions to each other, the particles 6 sequentially fill the pores 8 until they form a layer substantially equal in potential to the screen electrode 5. The electric field E1 between the screen electrode 5 and the light-transmitting conductive layer 2 retain the particles 6 in the pores 8. The particles 6 are therefore prevented from flying about due to, e.g., a centrifugal force ascribable to the rotation of the particle conveying body 10.

The particle conveying body 10 in rotation conveys the particles 6 to a position where the particles 6 face, but does not contact, the paper sheet 25. An electric field that causes positively charged particles to move toward the facing electrode 21 is formed between the facing electrode 21 and the particle conveying body 10. At this instant, the potential of −150 V and ground potential are respectively deposited on the screen electrode 5 and light-transmitting conductive layer 2, as stated earlier. Potential of −300 V is deposited on the facing electrode 21. Each screen electrode 5 and facing electrode 21 are spaced from each other by, e.g., 300 $\mu$m.

FIG. 2 shows how the particles 6 are caused to fly toward the paper sheet 25, FIG. 3, by exposure effected in accordance with an image signal. First, the light source 22 emits the light 7 in accordance with the image signal. The light 7 is incident to the particles 6 via the base 1 and light-transmitting conductive layer 2. In response, new electron-hole pairs are formed in the charge generating material, which forms the surfaces of the particles 6. Subsequently, the electric field E1 between the screen electrode 5 and the light-transmitting conductive layer 2 separate electrons and holes. The electrons of the particles 6 leak to the conductive layer 2 with the result that the particles 6 are charged to positive polarity. The previously stated electric field between the facing electrode 21 and the conductive layer 2 causes the particles 6 with positive charge to fly toward the paper sheet 25 and deposit thereon, printing an image on the paper sheet 25. It is noteworthy that electron-hole pairs are formed only in the particles 6 existing in the exposed portion. The other particles 6 existing in unexposed portions maintain the negative charge or are charged almost to zero, but are not charged to positive polarity at all. The resulting image is therefore free from fog.

As the particles 6 are repeatedly charged to positive polarity and fly toward the paper sheet 25 in an instant, the particles 6 deposit on the paper sheet 25 in a preselected amount. The duration and intensity of exposure, for example, may be control led to control the amount of the particles 6 to deposit on the paper sheet 25. The particles 6 deposited on the paper sheet 25 are fixed by a conventional fixing process. The printing operation described above is practicable with the paper sheet 25 being conveyed at a practical speed of, e.g., about 57 mm/sec.

While the illustrative embodiment forms a gap of 100 $\mu$m between the filling electrode 23 and the screen electrode 5, the gap may be as small as possible so long as it does not prevent the particles 6 from filling the pores 8. A smaller gap allows the potential difference between the filling electrode 23 and the screen electrode 5 to be reduced even to zero. While the screen electrode 6 and paper sheet 25 are shown as being spaced from each other, the paper sheet 25 may contact the screen electrode 5, if desired. With this alternative configuration, it is possible to reduce the potential difference between the facing electrode 21 contacting the rear of the paper sheet 25 and the screen electrode 5 to almost zero.

The potentials described above are only illustrative. The crux is that the potentials allow the electric field of $10^4$ V/cm or above to be formed between the screen electrode 5 and the light-transmitting conductive layer 2 in order to separate the electrons and holes, as stated earlier. When use is made of negatively charged particles 6, as in the illustrative embodiment, the following relations in potential should only be satisfied:

light-transmitting conductive layer 2>screen electrode 5≧filling electrode 23 screen electrode 5>facing electrode 21

A specific procedure for producing the above-described image forming apparatus is as follows. First, to form the insulative screen 4, a photocuring resin is applied to the surface of the sleeve made up of the base 1 and light-transmitting conductive layer 2 by dip coating. At this instant, the viscosity and pulling rate of the coating liquid are control led such that the screen 4 is, e.g., 50 $\mu$m to 100 $\mu$m thick. The photocuring resin may be any one of, e.g., azide compounds, naphthoquinone diazide resins, dichromic acid resins, polyvinyl cinnamicacid resins, nylon resins, acrylate resins, epoxy resins, en-thiol resins, unsaturated polyester resins, epoxy resins, etc. In the illustrative embodiment, use is made of epoxy-acrylate resin TSR-810 available from TEIJIN LTD, which cures when illuminated by light having a particular wavelength of around 365 nm. In this case, the light source for curing the screen 4 is implemented by an ultraviolet radiator ML-501C available from USHIO INC. and using 500 W ultrahigh voltage, mercury lamp. After the coating step, a mask formed with a lattice pattern is positioned on the surface of the photocuring resin. Subsequently, the portions of the resin expected to form walls are exposed and cured while the other portions expected to form pores are left unexposed. For the mask, use is made of a thin film, PTFE (polytetrafluoroethylene) sheet highly transparent for light, so that the mask can be easily peeled off after curing.

After the mask has been peeled off, development using a developing liquid is effected in order to remove the resin from the non-cured portions. For this purpose, isopropyl alcohol may be sprayed onto the exposed liquid resin for 2 minutes. After the development, to remove the developing liquid, the sleeve is dried at, e.g., 80° C. for, e.g., 10 minutes in a thermostat. The resulting pores are observed through a microscope to see if they are evenly distributed. Subsequently, the previously mentioned light source again emits light sufficient to fully cure the resin over the entire surface of the resin, thereby insuring strength.

The pores of the actual screen 4 were measured by use of a scanning electron microscope (SEM). The measurement showed that each cavity, as seen from the top, was rectangular and had short sides of about 30 $\mu$m and long sides of about 60 $\mu$m while the lattice (walls between the pores) was about 12 $\mu$m wide. Further, each cavity was about 60 $\mu$m deep when the screen 4 was observed in a section.

After the curing of the resin, an electrode layer for forming the screen electrode 5 is formed on the surface of the resin. For example, an aluminum film that is about 250 Å thick is formed on the screen 4 by vacuum deposition or similar technology. In this manner, the screen and screen electrode 5 are formed.

It is to be noted that the base 1 is not essential if the light-transmitting conductive layer 2, screen 4 and screen electrode 5 can maintain the hollow, cylindrical configuration of the particle conveying body 10. For example, the particle conveying body 10 can achieve sufficient mechanical strength if the screen electrode 5 is formed by electroforming.

Figure 5A:
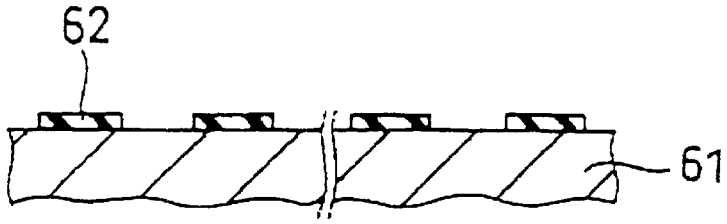
FIGS. 5A through 5D are sections demonstrating a specific method of producing a screen electrode included in the first embodiment.

A method of forming the screen electrode 5 by electroforming will be described hereinafter with reference to FIGS. 5A through 5D. First, as shown in FIG. 5A, a hollow, cylindrical mother mold 61 formed of stainless steel or similar conductive metal is prepared. Photoresist is coated on the outer periphery of the mother mold 61 and then patterned to form an insulation film 62 corresponding in position to the pores 8. The mother mold 61 has an outside diameter substantially equal to the inside diameter of the screen electrode 5. Also, the mother mold 61 is provided with a surface accurate enough to effect desirable transfer during electroforming to follow.

Figure 5B:
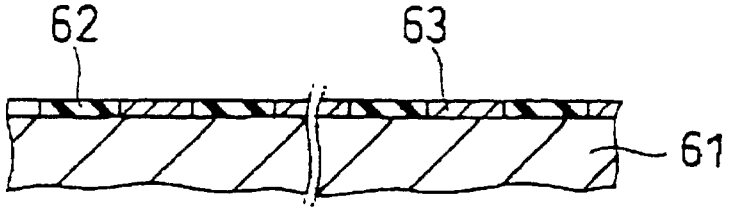

As shown in FIG. 5B, electroforming is effected to cause metal to precipitate on the outer periphery of the mother mold 61 except for the portion where the insulation fi m 62 is present. As a result, a metallic mesh sleeve 63 is formed on the mother mold 61. The mesh sleeve 63 is, e.g., about 20 $\mu$m to 100 $\mu$m thick and seamless in the circumferential direction. For the mesh sleeve 63, use may be made of, e.g., copper, iron, nickel, silver or gold. Nickel is desirable from, e.g., the corrosion resistance standpoint. Further, the mesh sleeve 63 should preferably have a Vickers hardness Hv of 50 to 1,500, more preferably 100 to 1,200.

Figure 5C:
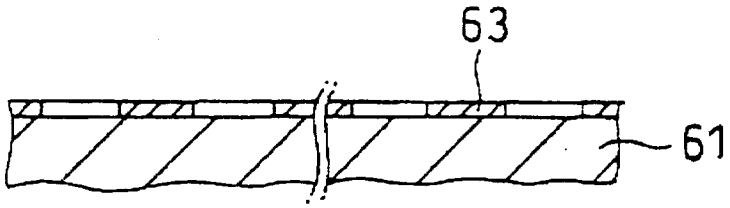

Subsequently, as shown in FIG. 5C, the mother mold 61 is immersed i n, e.g. , an organic solvent. As a result, the insulation film 62 is dissolved in the solvent and removed thereby.

Figure 5D:
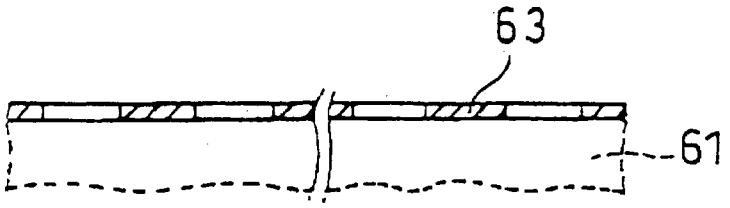
Figure 6:
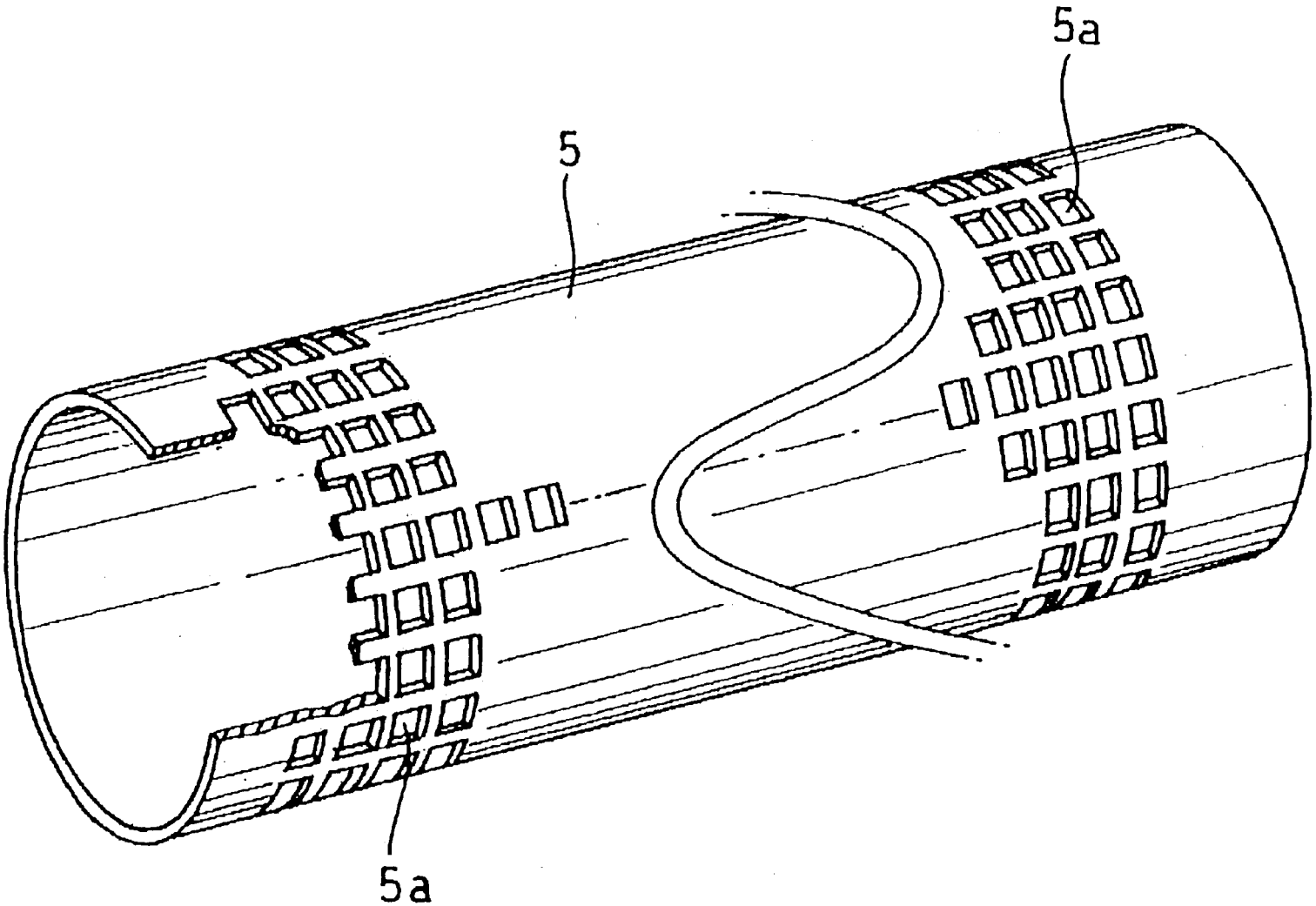
FIG. 6 is a perspective view of the screen electrode.

Finally, as shown i n FIG. 5D, the mother mold 61 is separated from the mesh sleeve 63. As a result, as shown in FIG. 6, the screen electrode 5 formed with a number of rectangular holes 5*a* is completed. The procedure described above provides the screen electrode 5 with uniform, sufficient thickness while freeing it from defects.

After the fabrication of the screen electrode 5, the insulative screen 4 is formed on the inner periphery of the electrode 5. Specifically, an about 100 $\mu$m thick insulation layer is formed on the inner periphery of the screen electrode 5. The insulation layer may be implemented by organic, positive type photoresist, e.g., resin for plating PMER available from TOKYO OHKA KOGYO CO., LTD or alkali-soluble novolak resin. For example, to prepare the above photoresist, a phenol, cresol, xylenol or similar aromatic, hydroxy compound and formaldehyde are condensed in the presence of an oxidizing catalyst. Subsequently, a compound containing a quinondiazide radical, particularly naphthoquinone-1,2-diazide sulfonic acid ester belonging to a family of aromatic polyhydroxy compounds, is added to the above condensation as a photoconductive substance.

It is necessary to precisely control the thickness of the insulation layer in order to uniform the number of particles 6 in the pores 8, which effects image density. Precise control is achievable with a coating method. A specific coating method is such that after the screen electrode 5 has been positioned upright with its axis extending vertically, the outer periphery of the electrode 5 is covered with a cover mask. The electrode 5 is then immersed in a positive type photoconductive liquid and then pulled out.

Another specific coating method is such that after the screen electrode 5 has been positioned upright, a stage loaded with a positive type, photoconductive resin liquid is moved within the electrode 5 from the top to the bottom. Still another coating method is such that after a positive type, photoconductive resin liquid has been applied (dropped) to the inner periphery of the screen electrode 5 in the circumferential direction, the electrode is caused to spin about its axis at a high speed. Such a coating method is desirable when the pores of the screen electrode 5 is small in area or in number, i.e., when the aperture ratio is small. This is because the coating method allows a minimum of resin to leak and does not need the cover mask.

Particularly, when the screen electrode 5 is caused to spin at a high speed, a centrifugal force acting on the photoconductive resin allows the insulation film to be formed on the inner periphery of the electrode 5 with a uniform thickness. The insulation layer can be provided with any desired thickness if the viscosity and amount of the photoconductive resin and the spinning speed of the screen electrode 5 are strictly controlled. Assume that the screen electrode 5 must spin at a low speed because the electrode 5 has a great pore ratio and low resolution and because the viscosity of the liquid is low. Then, the liquid stops up the fine pores of the screen electrode 5. However, if the amount of the liquid is small enough to prevent the liquid from turning round to the outer periphery of the screen electrode 5, the resin stopping up the apertures is successfully dissolved and removed during exposure and development.

Further, the high-speed spinning type of coating method is feasible for quantity production because it allows the screen electrode 5 to be baked at the same time as it is coated. Specifically, after or during the coating of the resin liquid, the coating may be baked at 100° C. for 15 minutes in a high-temperature bath. This causes the solvent to evaporate not only from the outer periphery of the screen electrode 5, but also from the fine pores 8. Consequently, an insulation layer free from the solvent is formed on the inner periphery of the screen electrode 5 in a short period of time.

Subsequently, the insulation layer is perforated by the following procedure. First, a high voltage, mercury lamp, for example, radiates light to the outer periphery of the screen electrode 5 in order to expose the insulation layer. If desired, a plurality of mercury lamps are arranged around the screen electrode 5 at equally spaced locations so as to radiate light at the same time. Alternatively, an arrangement may be made such that a stationary mercury lamp having an axis parallel to the axis of the screen electrode 5 radiates light while the screen electrode 5 with a flange and a shaft attached thereto beforehand is caused to spin. In this case, assume that every point of the insulation layer, which is a positive type, photoconductive resin, is illuminated by the same cumulative amount of light (product of illumination and duration of illumination). Then, if the light beams incident to the portions to be removed is parallel and is perpendicular to the surface of the screen electrode, then a slit plate capable of preventing the light from turning round may be used for exposure.

Assume that the amount of radiation incident to the photoconductive resin exceeds a particular amount t1. Then, the dissolution of the resin in the developing liquid rapidly proceeds with an increase in the amount of radiation. When the amount of radiation exceeds t2 that minimizes the remainder of the resin left undissolved is incident to the resin, the maximum amount of resin dissolves in the developing liquid at all times. It will therefore be seen that the amount of radiation of t2 or above should preferably be applied to the resin during exposure. This promotes easy control over exposure and therefore quantity production. Moreover, because the resin and the screen electrode 5 that plays the role of a mask during exposure closely contact each other, high resolution achievable. In addition, the conventional step of peeling a mask after exposure is not necessary. Such a conventional step, which is particular to proximity exposure, increases the number of steps and is apt to bring about defective pores.

Subsequently, the portions of the photoconductive layer are removed by development so as to form through holes.

For development, the photoconductive layer may be immersed in a developing liquid together with the screen electrode 5. Alternatively, a developing liquid may be sprayed at a high pressure onto the outer periphery of the screen electrode 5 and the inner periphery of the photoconductive layer. Assume that light transmission and a film forming ability are sufficiently high, but the illuminated portions are low in development, i.e., that the photoconductive resin does not dissolve at a time. Then, the exposing and developing steps may be repeated a plurality of times. Also, the coating, exposing and developing steps may be repeated if the film forming ability of the photoconductive resin is too low to guarantee a sufficient film thickness. In this manner, an adequate perforating method is selected on the basis of the light transmission, film forming ability and dissolving ability of the photoconductive resin used. The development may be followed by postbaking, if desired. After the development, the developing liquid present on the surface of the insulation layer is washed away by pure water. The insulation layer is then dried to complete the insulative screen 4.

Next, a light-transmitting, conductive layer is formed on the inner periphery of the above-described insulative screen 4. To form the conductive layer, a conductive coating liquid based on, e.g., ITO or SnO may be coated on the screen and then dried in the same manner as in the step of forming the insulation layer on the screen 4. The conductive layer may be formed by the vacuum deposition or the sputtering of, e.g., aluminum.

As stated above, electroforming can form the screen electrode 5 without resorting to the light-transmitting base 1. The resulting particle conveying body consists only of the conductive layer, insulative screen, and screen electrode.

A method of producing the photoconductive, colored particles 6 will be described hereinafter. Insulative toner particles produced by, e.g., conventional polymerization and having a volumetric center paticle size of, e.g., about 8.3 $\mu$m is used as mother particles. A charge generating material is immobilized on the surfaces of the toner particles for 2 minutes at a revolution speed of 13,000 rpm by, e.g., a hybridizer Type 0 available from NARA KIKAI SEISAKUSHO. For the charge generating material, use may be made of oxytitanium phthalocyanine having the maximum particles size of, e.g., about 0.4 $\mu$m and produced by a method disclosed in Japanese Patent No. 2,907,121. While this document applies an oxytitanium phthalocyanine crystal to the charge generating layer of a split-function type organic photoconductor, we found that particles exhibiting desirable photoconductivity were achievable by covering colored particles with oxytitanium phthalocyanine. More specifically, a series of researches and experiments showed that oxytitanium phthalocyanine was superior in sensitivity to light to copper phthalocyanine or non-metal phthalocyanine and allowed colored particles to fly instantaneously to thereby increase a recording speed. In the illustrative embodiment, 13.6 wt % of oxytitanium phthalocyanine is added to insulative toner.

In the illustrative embodiment, the colored particles 6 contain a material that generates charge only when exposed. This, coupled with the screen electrode 5 positioned on the top of the screen 4, allows an electric field of $10^4$ V/cm or above to be applied to the particles 6. It is therefore possible to cause the particles 6 to fly directly toward the paper sheet 25 with a simple process and to cause only the particles 6 lying in an exposure width A to fly. More specifically, only the particles 6 lying in an area that substantially fully corresponds to an image exposure area fly and print an image on the paper sheet 25. This enhances resolution and thereby prints an image with strict exposure resolution.

On the other hand, Prior Art 1 has the problem discussed previously with reference to FIG. 1 because it uses conductive, colored particles. The particles flying over the entire range D, FIG. 1, increase the width of thin lines or otherwise deteriorate resolution. By contrast, the illustrative embodiment frees the edges of thin lines from blurring and thereby noticeably enhances the sharpness of an image. In addition, the illustrative embodiment prevents thin lines from being rendered thick.

Moreover, the illustrative embodiment uniformly charges the photoconductive, colored particles by use of an electric field and exposure, as distinguished from frictional charging. This derives the following advantages.

A first advantage is that the adhesion of particles to the doctor blade 26 is reduced. Generally, in the case where when nonmagnetic toner particles for electrophotography and used alone form a thin layer, a doctor blade presses the particles with a linear pressure as high as about 5 g/mm so as to form an about 10 $\mu$m thick layer, so that the particles are charged by friction. As a result, the particles adhere to the doctor blade. In the illustrative embodiment, the particles 6 may form a relatively thick layer because they are uniformly charged by an electric field and exposure. A linear pressure required of the doctor blade 26 is therefore noticeably lowered, obviating the adhesion of the particles 6 to the doctor blade 26. A second advantage is that because the particles 6 do not adhere to the doctor blade 26, an image printed on the paper sheet 25 is free from white stripes and other defects.

A third advantage is that because the particles 6 do not adhere to the doctor blade 26, the range of substances applicable to the particles 6 is noticeably broadened. Specifically, as for binder resin for the particles 6, use can be made of resin lower in melt viscosity than the binder resin of conventional photoconductive particles or that of conventional insulative toner. This successfully lowers temperature necessary for fixing the particles 6 on the paper sheet 25 and thereby realizes an energy saving, image forming apparatus.

In the illustrative embodiment, a coloring agent for the particles may be implemented by dyes in place of a conventional pigment. Specifically, insulative toner for electrophotography contains a coloring agent implemented by a pigment. On the other hand, ink for an ink jet system contains dyes. Dyes have higher transmission and chroma than pigments. The conventional electrophotographic system, however, cannot sometimes use dyes because it charges toner by friction. This is because dyes themselves often play the role of a frictional charge control agent and prevent toner from being charged by a preselected amount.

Assume that dyes must be applied to colored particles for the electrophotographic system in order to, e.g., implement chroma and light transmission close to those of the ink jet system or to match the tone of an image printed by the ink jet system and that of an image printed by the electrophotographic system. Then, if use is made of the apparatus of the illustrative embodiment that does not rely on frictional charging, there can be used dyes, which are desirable in chroma and light transmission, as the coloring agent of the particles 6. At the same time, the tone of the resulting image can be readily matched to the tone of an image printed by the ink jet system. Furthermore, dyes render an image printed on, e.g., an OHP (OverHead Projector) sheet more transparent to light than pigments.

Figure 7:
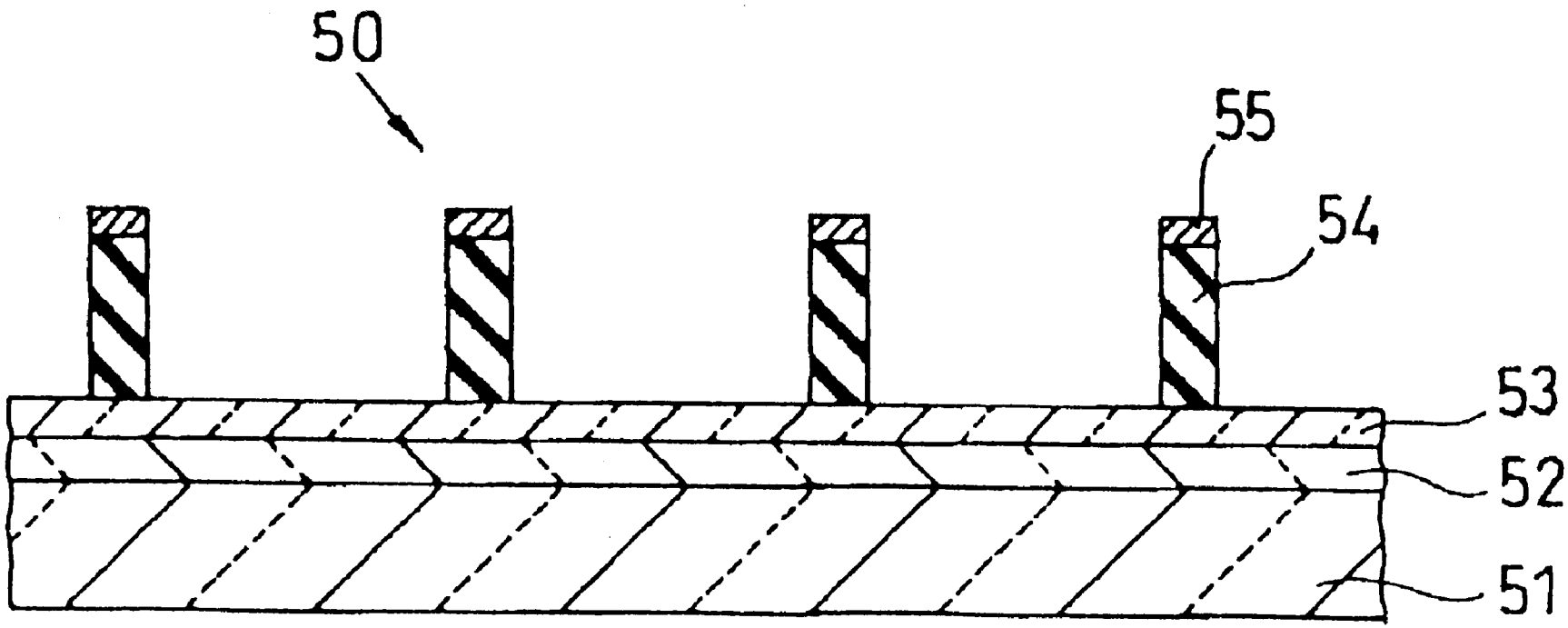
FIG. 7 is a section showing a second embodiment of the present invention.

Reference will be made to FIG. 7 for describing a second embodiment of the present invention. As shown, a particle conveying body 50 additionally includes an anti-holeinjection layer 53 between a light-transmitting, conductive layer 52 and an insulative screen 54. More specifically, the particle conveying body 50 includes a light-transmitting base 51 implemented by a PET sleeve having a wall thickness of 50 $\mu$m. The light-transmitting conductive layer 52 is formed on the base 51 and implemented by, e.g., an ITO film. The anti-holeinjection layer 53, which obstructs the injection of holes, is formed on the light-transmitting conductive layer 52. An insulative screen 54 and a screen electrode 55 are sequentially formed on the anti-holeinjection layer 53 in the same manner as in the first embodiment. As for the rest of the configuration, this embodiment is identical with the previous embodiment.

The anti-holeinjection layer 53 should preferably be implemented as a 0.5 $\mu$m thick layer formed by coating and then drying, e.g., a methanol solution of metoxymethyl nylon resin. The anti-injection layer 53 prevents holes from being injected from ITO whose work function is about 4 eV to 5 eV into the valence electron band of nylon. It follows that holes are prevented from being injected, in the dark, from the light-transmitting conductive layer 52 into the photoconductive, colored particles, not shown, charged to negative polarity. This further reduces the fog of an image.

Further, the illustrative embodiment does not charge the particles by friction and therefore achieves the same advantages as the previous embodiment. Specifically, because the particles are prevented from adhering to the doctor blade, not shown, the ratio of the coloring agent to the entire particle can be increased. This not only realizes an image close in quality to an ink image with a small amount of particles, but also reduces the required thickness of the particle layer. Further, fixing temperature can be lowered to save energy because the particles contain binder resin lower in melt viscosity than conventional binder resins.

Figure 8:
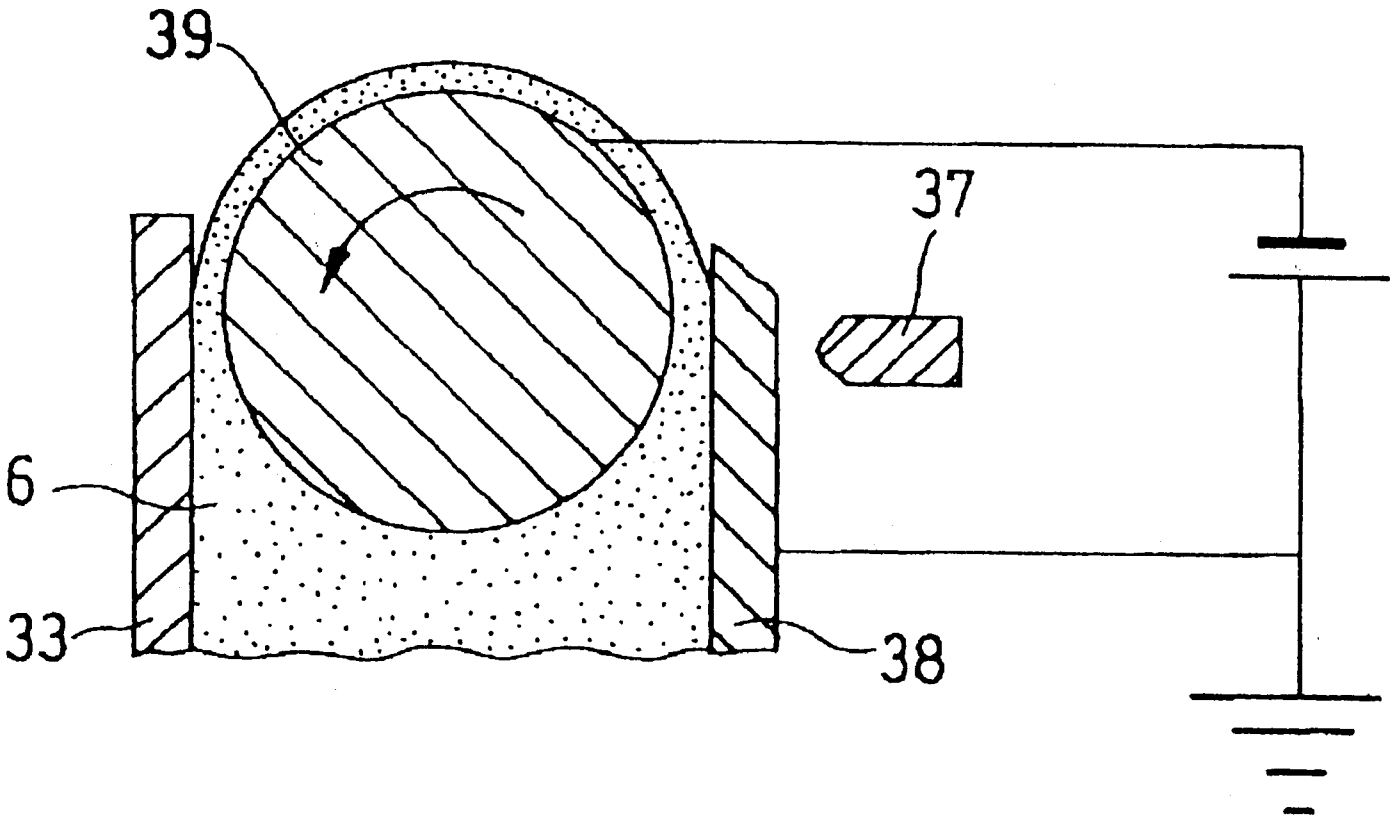
FIG. 8 is a section showing a third embodiment of the present invention.

FIG. 8 shows a particle reservoir section representative of a third embodiment of the present invention. This embodiment is identical with the first embodiment except for the position of the light source that uniformly charges the particles 6. As shown, the reservoir or container 33 accommodates a filling electrode 39 and a doctor blade 38. In the illustrative embodiment, a light source 37 for charging the particles 6 and thinning the layer of the particles 6 is positioned outside the container 33 and faces the filling electrode 39 with the intermediary of the doctor blade 38. The light source 37 exposes the particles 6 via the doctor blade 38.

In the illustrative embodiment, the doctor blade 38 is implemented as a light-transmitting plate. Light issuing from the light source 37 uniformly charges the thin particle layer at a position where the filling electrode 39 and doctor blade 38 are closest to each other. While the doctor blade 38 is generally identical with the doctor blade 26 of the first embodiment, it may be implemented by a PET plate formed with a light-transmitting ITO layer as a light-transmitting conductive layer. As for the rest of the configuration, this embodiment is identical with the first embodiment.

A fourth embodiment of the present invention will be described hereinafter although it is not shown specifically. While the first to third embodiments each charge the particles by uniform exposure and an electric field, the fourth embodiment uses frictional charging. Frictional charging makes the light source 27, FIG. 3, needless. The illustrative embodiment uses a metallic roller as a charge electrode and causes the photoconductive, colored particles to form a layer on the metallic roller.

In the illustrative embodiment, a doctor blade is implemented by, e.g., chrome stainless steel SUS prescribed by JIS (Japanese Industrial Standards). The doctor blade rubs the particles against the metallic roller to thereby charge the particles to negative polarity. At this instant, the doctor blade is provided with potential equal to or lower than potential deposited on the metallic roller. While the blade of the illustrative embodiment needs a linear pressure as high as the conventional linear pressure, the illustrative embodiment is simpler in configuration than the first embodiment because a light source does not have to be disposed in a charge electrode. The illustrative embodiment is comparable with the first embodiment as to resolution and the obviation of fog.

Figure 9:
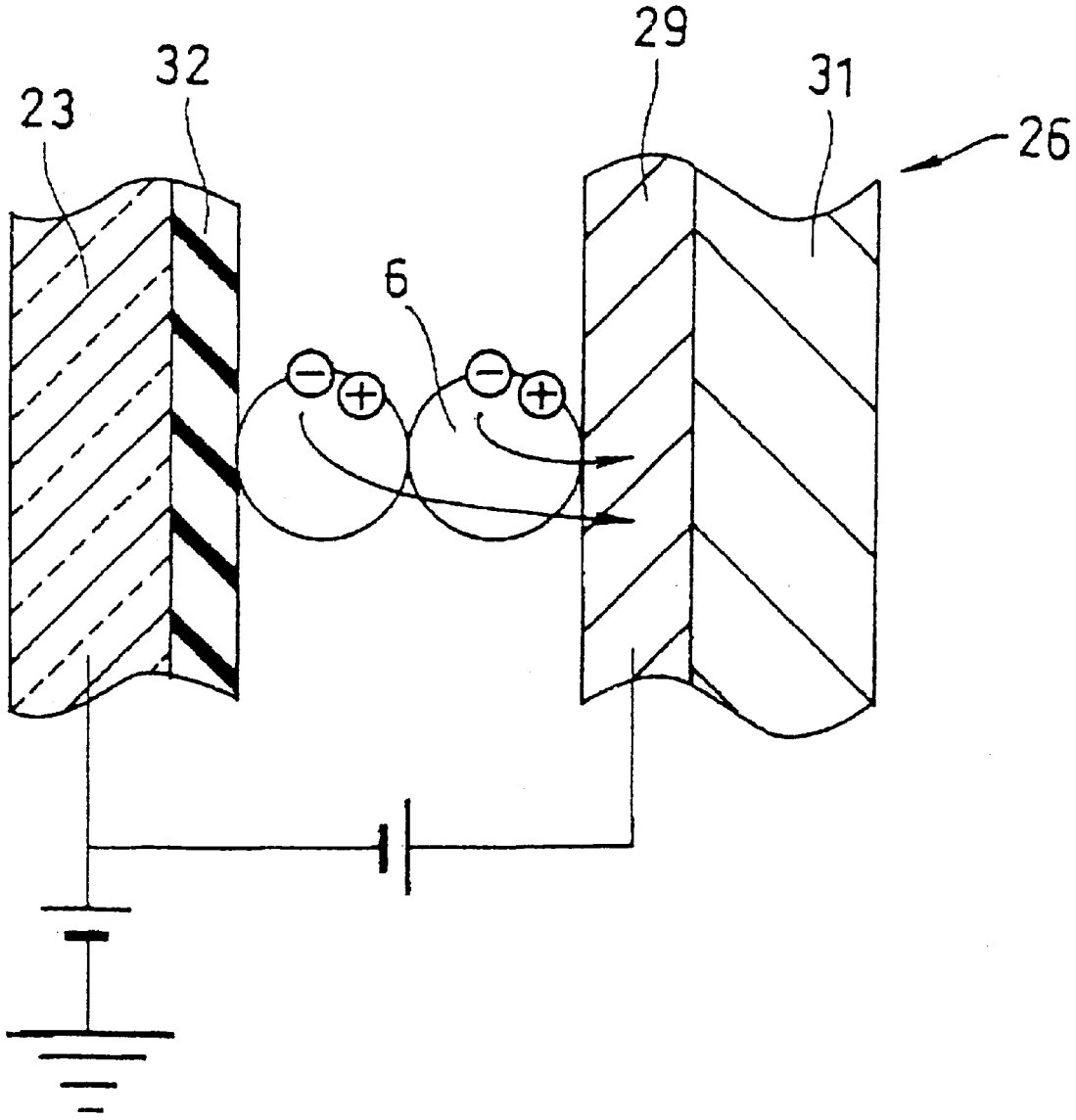
FIG. 9 is a view showing a fifth embodiment of the present invention.

Referring to FIG. 9, a fifth embodiment of the present invention will be described. While the first to fourth embodiments each uniformly charge the colored particles 6 stored in the reservoir to negative polarity, the fifth embodiment charges them to positive polarity. As shown, a light-transmitting insulative layer 32 is formed on the light-transmitting filling electrode 23. To charge the particles 6 to positive polarity, a potential of, e.g., +260 V and a potential of, e.g., +200 V are respectively deposited on the conductive layer 29 of the doctor blade 26 and the filling electrode 23. The insulative layer 32 has a thickness selected to be smaller than the thickness of the particle layer, e.g., 30 $\mu$m in order to allow the electric field to effectively act on the particle layer, while obviating charge migration.

As shown in FIG. 9, electron-hole pairs are generated in the charge generating material of the particles 6. Exposure from a light source identical with the light source 27, FIG. 3, and an electric field formed between the filling electrode 23 and the conductive layer 29 cooperate to separate the electrons and holes. Only the electrons leak to the conductive layer 29 of the doctor blade 26 with the result that the particles 6 are charged to positive polarity and deposit on the filling electrode 23. Thereafter, the charged particles fill the pores of the particle conveying body 10 and then fly toward a recording medium in the same manner as in the first embodiment. In the illustrative embodiment, the particles 6 are charged to positive polarity, the direction of the electric field is opposite to the direction of the first embodiment. Therefore, the following relations hold as to potential:

A light-transmitting conductive layer<screen electrode≦filling electrode screen electrode<facing electrode The particle conveying body may be configured in the same manner as in the first embodiment. Steps to follow will be described with reference to FIG. 3. It is to be noted that in the illustrative embodiment, the polarities of the power supplies shown in FIG. 3 are inverted.

Because the particles 6 are charged to positive polarity, the particles 6 are caused to fill the pores 8 of the screen 4 by an electric field opposite in direction to the electric field of the first embodiment. Subsequently, the particle conveying body 10 conveys the particles to a position where they face the paper sheet 25. An electric field for causing the particles 6, which are charged to negative polarity, to move toward the facing electrode 21 is formed between the facing electrode 21 and the light-transmitting conductive layer 2 of the particle conveying body 10. In the illustrative embodiment, a potential of 300 V, a potential of 150 V and ground potential are respectively assigned to the facing electrode 21, screen electrode 5 and a light-transmitting conductive layer 2 by way of example. The gap between the screen electrode 5 and the facing electrode 21 is selected to be 300 $\mu$m. In these conditions, an electric field of $2.5\times10^4$ V/cm can be formed between the screen electrode 5 and the light-transmitting conductive layer 2. Light issuing from the light source 22 in accordance with an image signal illuminates the particles 6 present in the pores of the screen 4 via the base 1. As a result, the particles 6 are charged to negative polarity and fly toward the paper sheet 25.

More specifically, the exposure effected in accordance with the image signal forms electron-hole pairs in the charge generating material covering the surfaces of the particles 6. The high-tension electric field formed between the screen electrode 5 and the light-transmitting conductive layer 2 separates the electrons and holes. The holes leak to the light-transmitting conductive layer 2 with the result that the particles 6 are charged to negative polarity by the electrons. At this instant, the particles 6 in the unexposed portions remain positively charged or are charged to zero potential, but are not negatively charged at all, so that the resulting image is not foggy.

In the illustrative embodiment, the particles 6 are uniformly exposed via the filling electrode 23 at the position where the filling electrode 23 and doctor blade 26 are closest to each other. Alternatively, the particles 6 may be uniformly exposed via the doctor blade 26, in which case the doctor blade 26 will be formed of a material transparent to light.

A sixth embodiment of the present invention will be described that is identical with the fourth embodiment except for the following. While the fourth embodiment charges the particles 6 to positive polarity by friction, the illustrative embodiment charges them to negative polarity by friction. The charge electrode is implemented as a metallic roller while the doctor blade is implemented by, e.g., chrome stainless steel SUS. The doctor blade rubs the particles against the metallic roller to thereby charge the particles to positive polarity. At this instant, the doctor blade is provided with potential higher than potential deposited on the charge electrode.

Figure 10:
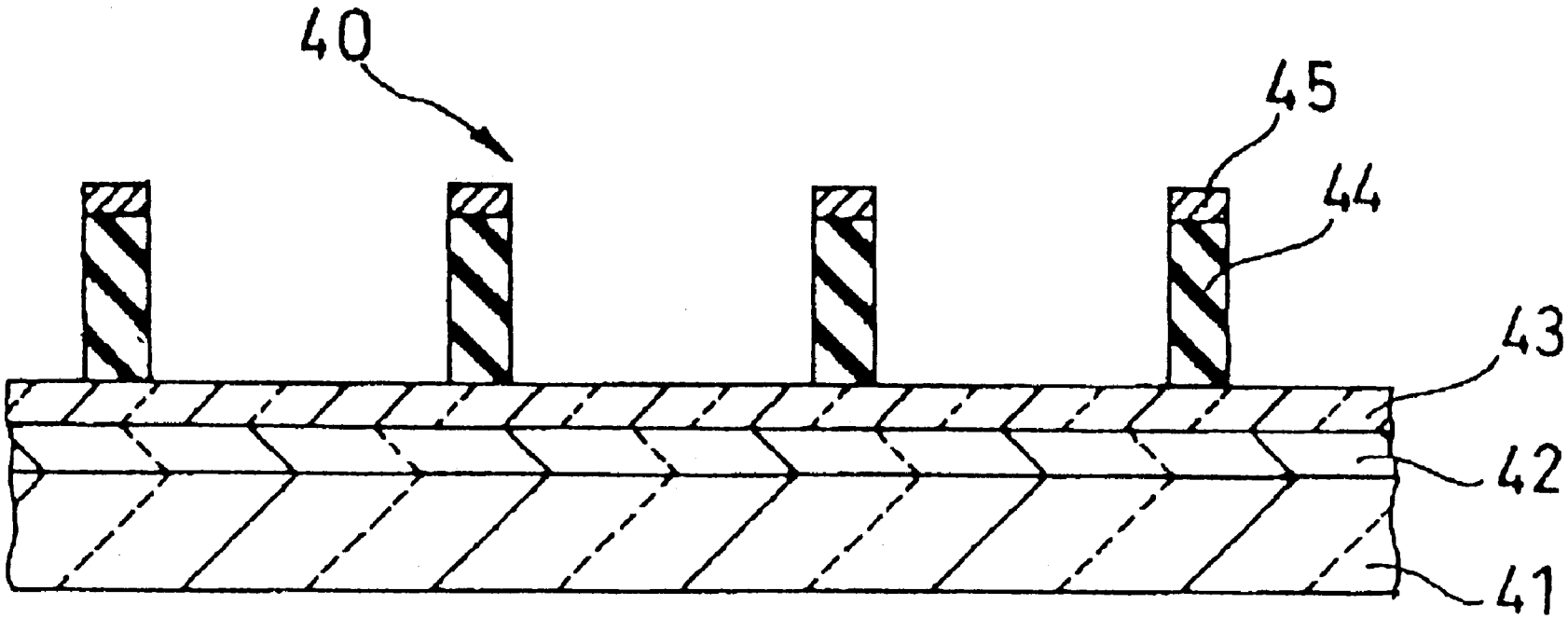
FIG. 10 is a section showing a seventh embodiment of the present invention.

Reference will be made to FIG. 10 for describing a seventh embodiment of the present invention. While the fifth and sixth embodiments each convey the positively charged particles with the same particle conveying body as the first embodiment, the seventh embodiment conveys them with a different particle conveying body. As shown, a particle conveying body 40 additionally includes a hole transport layer 43 between a light-transmitting conductive layer 42 and an insulative screen 44. More specifically, the particle conveying body 40 includes a base 41 transparent for light. The conductive layer 42 and hole transport layer 43 are sequentially formed on the base 41. A porous, insulative screen 44 formed with a number of pores and a screen electrode 45 are sequentially formed on the hole transport layer 43 in the same manner as in the first embodiment.

The base 41 may be implemented by a PET sleeve by way of example. The screen 44 and screen electrode 45 may be formed in the same manner as in the first embodiment. An image forming process is identical with the process of the fifth embodiment.

In the illustrative embodiment, the hole transport layer 43 prevents electrons from being injected from the light-transmitting conductive layer 42 into the particles that are charged to positive polarity in the dark beforehand. This successfully reduces the degree to which the positive charge of the particles is attenuated, and thereby further reduces fog.

A specific method of forming the hole transport layer 43 is as follows. Polycarbonate resin Z200 available from MITSUBISHI GAS CHEMICAL CO., INC. and a bis (triphenylamine) styryl derivative are mixed in a mass ratio of 1:0.8 and then dissolved in tetrahydrofuran to prepare a coating liquid. The coating liquid is coated by dip coating in order to form an about 10 $\mu$m thick layer.

In Prior Art 2 discussed earlier, a high-tension electric field does not exist between the screen electrode 45 and light-transmitting the conductive layer 42. Therefore, when use is made of an organic charge generating material, the separation of electrons and holes or charge migration substantially does not occur, or the charge migration time is too long to record an image at a practical printing speed. By contrast, the illustrative embodiment causes a sufficiently high electric field to act on the particles present in the screen 44, allowing an image to be printed at a practical speed.

An eighth embodiment of the present invention will be described hereinafter. This embodiment uses photoconductive, colored particles having a small particle size and produced by the following procedure. Insulative toner produced by conventional polymerization and having a volumetic center particle size of, e.g., 2.7 $\mu$m is used as mother particles. About 34 wt % of oxytitanium phthalocyanine, for example, is immobilized on the surfaces of the particles as in the first embodiment. The illustrative embodiment prints an image by using the same image forming apparatus as the first embodiment.

It is difficult with the conventional electrophotography, which relies on frictional charging, to use the above-described small particles because such particles lower image density, cannot easily form a thin layer, fly about to contaminate the inside of an apparatus, and cannot be removed when deposited on a photoconductive element. The illustrative embodiment is a drastic solution to such problems and insures high-resolution images. In addition, the illustrative embodiment is practicable even with colored particles of small size that have heretofore been not usable in practice. This remarkably improves the resolution of an image.

A ninth embodiment of the present invention will be described hereinafter. The illustrative embodiment increases the ratio of the coloring agent to the entire colored particle by the following specific procedure. 30 wt % of carbon black (Ketchen Black EC available from Mitsubishi Petrochemical Co., Ltd.) is added to, e.g., polyester binder resin, kneaded and then pulverized by conventional technologies to thereby produce insulative, colored particles having a volumetric center particle size of about 8 $\mu$m. Subsequently, 13 wt % of oxytitanium phthalocyanine, for example, is immobilized on the above colored particles in the same manner as in, e.g., the first embodiment so as to produce photoconductive, colored particles. These colored particles contain the coloring agent in a far greater ratio than conventional toner for electrophotography. With such colored particles, the illustrative embodiment is capable of forming attractive images by using the same image forming apparatus as the first embodiment.

The illustrative embodiment does not charge the particles by friction and therefore allows the ratio of the coloring agent to be increased. An image close in quality to an ink image is therefore achievable with a small amount of particles.

While the illustrative embodiment uses oxytitanium phthalocyanine, which is an organic charge generating material, covering the insulative particles, use may be made of any other conventional particles so long as they are photoconductive. For example, there may be used particles with inorganic zinc oxide or selenium added to its inside or outside or particles with a triphenylamine derivative dispersed in polycarbonate resin.

To summarize the illustrative embodiments shown and described, colored particles are implemented by photoconductive, colored particles. The particles are uniformly charged by uniform exposure and an electric field or charged by friction to negative polarity or positive polarity. The charged particles deposit on a filling electrode in a thin layer. An electric field causes the charged particles to fly from the filling electrode to a particle conveying body via a gap and fill only the pores of an insulative screen provided on the particle conveying body. The particle conveying body conveys the particles to a position where the body faces a facing electrode with the intermediary of a recording medium. An LED array, for example, emits light to the particle layer via a light-transmitting conductive layer in accordance with an image signal. The light causes electron-hole pairs to be formed in the charge generating material covering the surfaces of the particles. A first electric field formed between an electrode layer formed on the surface of the screen and the conductive layer separates the electrons and holes. The electrons or the holes leak to the conductive layer. As a result, the particles in the exposed portion are inverted in polarity and fly toward the recording medium due to a second electric field formed between the facing electrode and the conductive layer, forming an image on the recording medium. On the other hand, the particles in an unexposed portion remain charged to the initial polarity or charged to almost zero potential, but is not charged to the opposite polarity at all. This is successful to obviate a foggy image.

In summary, in accordance with the present invention, an image forming apparatus uses colored particles including a material that generates charge only when exposed. A screen electrode is formed on the surface of an insulative screen. It is therefore possible to apply an electric field of $10^4$ V/cm or above to the particles. Such an electric field allows a simple process to cause the particles to directly fly toward a recording medium. This, coupled with the fact that the area from which the particles fly substantially accurately corresponds to an image exposure area, obviates the blur of the edges of thin lines and insures a sharp image. In addition, thin lines are prevented from being rendered thick. The apparatus therefore remarkably improves the resolution of an image. Moreover, the electric field formed by the screen electrode confines the particles in the pores of the screen until image recording and prevents them from flying about due to a centrifugal force and smearing in the side of the apparatus. In addition, the particles in the unexposed portions do not fly when subjected only to the electric field, so that an attractive image free from fog is insured.

Moreover, in the apparatus of the present invention, a photoconductive layer is absent beneath the insulative screen. This solves the problem discussed previously in relation to Prior Art 1 and enhances the precise configuration of the insulative screen and therefore further enhances resolution.

Various modifications will become possible for those skilled in the art after receiving the teachings of the present disclosure without departing from the scope thereof.

What is claimed is:

1. An image forming apparatus for causing photoconductive, colored particles to deposit on a recording medium, said image forming apparatus comprising:

a particle conveying body comprising a light-transmitting conductive layer, an insulative screen provided on said light-transmitting conductive layer and formed with a plurality of pores to be filled with the colored particles, and an electrode layer formed on a top of said screen;

a particle feeding section for feeding the colored particles charged to a first polarity to said particle conveying body;

a facing electrode facing said particle conveying body with the intermediary of a recording medium;

an exposing member for exposing the colored particles via said light-transmitting conductive layer in accordance with an image signal to thereby charge said colored particles to a second polarity;

first electric field applying means for applying a first electric field, which electrically attracts the colored particles charged to the first polarity toward said light-transmitting conductive layer, between said light-transmitting conductive layer and said electrode layer;

second electric field applying means for applying a second electric field, which electrically attracts the charged particles charged to the second polarity toward said facing electrode, between said facing electrode and said light-transmitting conductive layer; and body driving means for causing said particle conveying body to move between said particle feeding section and said facing electrode in circulation.

2. The apparatus as claimed in claim 1, wherein said particle feeding section comprises: a a reservoir storing the colored particles;

a hollow, cylindrical filling electrode disposed in said reservoir and contacting the colored particles at a circumference thereof;

electrode driving means for causing said filling electrode to rotate;

a feeding section facing electrode facing said filling electrode with the intermediary of the colored particles;

a feeding section exposing member for uniformly charging the colored particles between said feeding section facing electrode and said filling electrode to thereby charge said colored particles to the first polarity; and third electric field applying means for applying a third electric field, which causes the colored particles charged to the first polarity to fly toward said particle conveying body away from said filling electrode when a circumferential surface of said filling electrode is rotated to said particle conveying body, between said light-transmitting conductive layer and said filling electrode.

3. The apparatus as claimed in claim 2, wherein said filling electrode is transparent for light while said filling section exposing member is accommodated in said filling electrode for exposing the colored particles via said filling electrode.

4. The apparatus as claimed in claim 3, wherein said feeding section facing electrode regulates a thickness of a layer of the colored particles deposited on the circumferential surface of said filling electrode.

5. The apparatus as claimed in claim 4, wherein said particle conveying body is hollow, cylindrical with said light-transmitting conductive layer constituting an outermost layer while said body driving means causes said particle conveying body to rotate.

6. The apparatus as claimed in claim 5, wherein said filling electrode has an insulation layer formed on a surface thereof and is provided with a potential higher than a potential deposited on said feeding section facing electrode.

7. The apparatus in accordance with claim 6, wherein said particle conveying body further comprises an anti-holeinjection layer between said light-transmitting conductive layer and said screen for preventing holes from being injected.

8. The apparatus in accordance with claim 7, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2>V3$$

$$V2>V4.$$

9. The apparatus in accordance with claim 2, wherein said feeding section facing electrode is transparent for light while said feeding section exposing member exposes the colored particles via said feeding section facing electrode.

10. The apparatus as claimed in claim 9, wherein said feeding section facing electrode regulates a thickness of a layer of the colored particles deposited on the circumferential surface of said filling electrode.

11. The apparatus acclaimed in claim 10, wherein said particle conveying body is hollow, cylindrical with said light-transmitting conductive layer constituting an outermost layer while said body driving means causes said particle conveying body to rotate.

12. The apparatus as claimed in claim 11, wherein said filling electrode has an insulation layer formed on a surface thereof and is provided with a potential higher than a potential deposited on said feeding section facing electrode.

13. The apparatus in accordance with claim 12, wherein said particle conveying body further comprises an anti-injection layer between said light-transmitting conductive layer and said screen for preventing holes from being injected.

14. The apparatus in accordance with claim 13, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

15. The apparatus as claimed in claim 2, wherein said feeding section facing electrode regulates a thickness of a layer of the colored particles deposited on the circumferential surface of said filling electrode.

16. The apparatus as claimed in claim 15, wherein said particle conveying body is hollow, cylindrical with said light-transmitting conductive layer constituting an outermost layer while said body driving means causes said particle conveying body to rotate.

17. The apparatus as claimed in claim 16, wherein said filling electrode has an insulation layer formed on a surface thereof and is provided with a potential higher than a potential deposited on said feeding section facing electrode.

18. The apparatus in accordance with claim 17, wherein said particle conveying body further comprises an anti-holeinjection layer between said light-transmitting conductive layer and said screen for preventing holes from being injected.

19. The apparatus in accordance with claim 18, wherein assuming that a potential V1 is deposited on said light-transmitting conductive layer, that a potential V2 is deposited on said electrode layer overlying said screen, that a potential V3 is deposited on said filing electrode, and that a potential V4 is deposited on said facing electrode, then there hold relations:

$$V1>V2\geqq V3$$

$$V2>V4.$$

20. The apparatus as claimed in claim 2, wherein said particle conveying body is hollow, cylindrical with said light-transmitting conductive layer constituting an outermost layer while said body driving means causes said particle conveying body to rotate.

21. The apparatus as claimed in claim 20, wherein said filling electrode has an insulation layer formed on a surface thereof and is provided with a potential higher than a potential deposited on said feeding section facing electrode.

22. The apparatus in accordance with claim 21, wherein said particle conveying body further comprises an anti-holeinjection layer between said light-transmitting conductive layer and said screen for preventing holes from being injected.

23. The apparatus in accordance with claim 22, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

24. The apparatus as claimed in claim 2, wherein said filling electrode has an insulation layer formed on a surface thereof and is provided with a potential higher than a potential deposited on said feeding section facing electrode.

25. The apparatus in accordance with claim 24, wherein said particle conveying body further comprises an anti-holeinjection layer between said light-transmitting conductive layer and said screen for preventing holes from being injected.

26. The apparatus in accordance with claim 25, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

27. The apparatus in accordance with claim 2, wherein said particle conveying body further comprises an anti-holeinjection layer between said light-transmitting conductive layer and said screen for preventing holes from being injected.

28. The apparatus in accordance with claim 27, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

29. The apparatus in accordance with claim 2, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

30. The apparatus as claimed in claim 2, wherein said filling electrode has an insulation layer formed on a surface thereof and is provided with a potential lower than a potential deposited on said feeding section facing electrode.

31. The apparatus as claimed in claim 30, wherein said particle conveying body further comprises a hole transport layer between said light-transmitting conductive layer and said screen.

32. The apparatus as claimed in claim 2, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1<V2\leqq V3$$

$$V2<V4.$$

33. The apparatus as claimed in claim 2, wherein a first power supply applies a voltage for forming an electric field of $10^4$ V/cm or above between said light-transmitting conductive layer and said electrode layer.

34. The apparatus as claimed in claim 2, wherein the colored particles are formed by adding oxytitaniumphthalocyanine to surfaces of the colored particles and immobilized on said surfaces.

35. The apparatus as claimed in claim 1, wherein said particle feeding section comprises:

a reservoir storing the colored particles;

a hollow, cylindrical filling electrode disposed in said reservoir and contacting the colored particles at a circumference thereof;

electrode driving means for causing said filling electrode to rotate;

a feeding section facing electrode facing a circumferential surface of said filling electrode with the intermediary of the colored particles for charging said colored particles to the first polarity by friction in cooperation with said filling electrode; and third electric field applying means for applying a third electric field, which causes the colored particles charged to the first polarity to fly toward said particle conveying body away from said filling electrode when the circumferential surface of said filling electrode is rotated to said particle conveying body, between said light-transmitting conductive layer and said filling electrode.

36. The apparatus as claimed in claim 35, wherein said feeding section facing electrode regulates a thickness of a layer of the colored particles deposited on the circumferential surface of said filling electrode.

37. The apparatus as claimed in claim 36, wherein said particle conveying body is hollow, cylindrical with said light-transmitting conductive layer constituting an outermost layer while said body driving means causes said particle conveying body to rotate.

38. The apparatus as claimed in claim 37, wherein said filling electrode has an insulation layer formed on a surface thereof and is provided with a potential higher than a potential deposited on said feeding section facing electrode.

39. The apparatus in accordance with claim 38, wherein said particle conveying body further comprises an anti-holeinjection layer between said light-transmitting conductive layer and said screen for preventing holes from being injected.

40. The apparatus in accordance with claim 39, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

41. The apparatus as claimed in claim 1, wherein said particle conveying body is hollow, cylindrical with said light-transmitting conductive layer constituting an outermost layer while said body driving means causes said particle conveying body to rotate.

42. The apparatus as claimed in claim 41, wherein said filling electrode has an insulation layer formed on a surface thereof and is provided with a potential higher than a potential deposited on said feeding section facing electrode.

43. The apparatus in accordance with claim 42, wherein said particle conveying body further comprises an anti-holeinjection layer between said light-transmitting conductive layer and said screen for preventing holes from being injected.

44. The apparatus in accordance with claim 43, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

45. The apparatus as claimed in claim 1, wherein said filling electrode has an insulation layer formed on a surface thereof and is provided with a potential higher than a potential deposited on said feeding section facing electrode.

46. The apparatus in accordance with claim 45, wherein said particle conveying body further comprises an anti-holeinjection layer between said light-transmitting conductive layer and said screen for preventing holes from being injected.

47. The apparatus in accordance with claim 46, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

48. The apparatus in accordance with claim 1, wherein said particle conveying body further comprises an anti-holeinjection layer between said light-transmitting conductive layer and said screen for preventing holes from being injected.

49. The apparatus in accordance with claim 48, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3$$

$$V2>V4.$$

50. The apparatus in accordance with claim 1, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1>V2\geqq V3.$$

51. The apparatus as claimed in claim 1, wherein said filling electrode has an insulation layer formed on a surface thereof and is provided with a potential lower than a potential deposited on said feeding section facing electrode.

52. The apparatus as claimed in claim 1, wherein said particle conveying body further comprises a hole transport layer between said light-transmitting conductive layer and said screen.

53. The apparatus as claimed in claim 1, wherein assuming that a potential V1 is deposited on said light-transmitting conductive layer, that a potential V2 is deposited on said electrode layer overlying said screen, that a potential V3 is deposited on said filling electrode, and that a potential V4 is deposited on said facing electrode, then there hold relations:

$$V1<V2\leqq V3$$

$$V2<V4.$$

54. The apparatus as claimed in claim 1, wherein a first power supply applies a voltage for forming an electric field of $10^4$ V/cm or above between said light-transmitting conductive layer and said electrode layer.

55. The apparatus as claimed in claim 1, wherein the colored particles are formed by adding oxytitanium phthalocyanine to surfaces of the colored particles and immobilized on said surfaces.

56. An image forming method comprising:

a step of uniformly charging photoconductive, colored particles to a first polarity;

a step of causing the colored particles charged to the first polarity to fill a plurality of pores of a particle conveying body that comprises a light-transmitting conductive layer, an insulative screen provided on said light-transmitting conductive layer and formed with said plurality of pores, and an electrode layer formed on a top of said screen;

a step of radiating light for exposure from a bottom side of said pores; and forming a first electric field, which electrically attracts the colored particles charged to the first polarity toward said light-transmitting conductive layer, between said electrode layer and said light-transmitting conductive layer;

causing the light and said first electric field to charge the colored particles to a second polarity opposite to the first polarity; and forming a second electric field between a facing electrode, which faces said particle conveying body with the intermediary of a recording medium, and said light-transmitting conductive layer to thereby cause the colored particles to fly toward and deposit on said recording medium.

57. The method as claimed in claim 56, wherein the step of uniformly charging the colored particles to the first polarity comprises uniformly exposing said colored particles while applying an electric field to said colored particles.

* * * * *